United States Patent [19]

Byrnes, Jr.

[11] Patent Number: 4,805,736

[45] Date of Patent: Feb. 21, 1989

[54] DISAPPEARING LADDER

[75] Inventor: John J. Byrnes, Jr., Lebanon, Conn.

[73] Assignee: Fabrication Specialists, Inc., Manchester, Conn.

[21] Appl. No.: 199,994

[22] Filed: May 26, 1988

[51] Int. Cl.[4] ..... E06C 9/06; E06C 1/383

[52] U.S. Cl. ..... 182/95; 182/156

[58] Field of Search ..... 182/156, 159, 160, 1, 182/21, 49, 93, 95

[56] References Cited

U.S. PATENT DOCUMENTS

| | | | |
|---|---|---|---|
| 81,436 | 8/1868 | Tompson, Jr. . | |
| 479,436 | 7/1892 | Lummus . | |
| 547,337 | 10/1895 | Deane . | |
| 579,328 | 3/1897 | McConnell . | |
| 655,923 | 8/1900 | Dutton . | |
| 794,729 | 7/1905 | McDonnall . | |
| 1,167,893 | 1/1916 | Fickinger | 182/1 |
| 1,189,514 | 7/1916 | Wallace | 182/1 |
| 1,198,739 | 9/1916 | Marciniak et al. . | |
| 1,235,411 | 7/1917 | Andrews . | |
| 2,498,375 | 2/1950 | Moore | 182/1 |
| 2,864,542 | 12/1958 | Marryatt | 182/156 |
| 3,311,195 | 3/1967 | Singer . | |
| 3,367,444 | 2/1968 | Meddick | 182/1 |

*Primary Examiner*—Reinaldo P. Machado

*Attorney, Agent, or Firm*—Chilton, Alix & Van Kirk

[57] ABSTRACT

A ladder includes a pair of spaced apart rails having upper and lower ends, and a plurality of substantially identical slats located between the rails. Each slat has a support axle or the like engaging the rails, and defining an axis of rotation for the slat. An actuating bar or rod is operatively connected to each of the slats for selectively and simultaneously rotating the slats from a closed position wherein the slats are substantially coplanar and parallel to the rails, to an open position wherein the slats are oriented transversely to the rails and thus form steps. The actuating bar or the like is restrained in the normally closed position. A trigger mechanism is located at the upper end of the rails and operatively connected to the actuating bar, for selectively releasing the restraining member, whereby the slats can rotate to the open position for use.

20 Claims, 5 Drawing Sheets

DISAPPEARING LADDER

BACKGROUND OF THE INVENTION

The present invention relates to outdoor ladders, and more particularly, to ladders of the type that are permanently or semi-permanently positioned for occasional use, such as swimming pool ladders and fire escape ladders.

U.S. Pat. Nos. 81,436 (Tomlison, Jr.), 479,436 (Lummus), and 655,923 (Dutton) disclose fire escape ladders having steps which are in a common plane when in a closed position, and which open, in a louvre fashion, when the fire escape frame is lowered. Although these ladders may be effective for their intended purpose of providing escape in the event of fire, they are unsightly, particularly for use on single family, detached homes, and they may be difficult to maneuver into the open, escape position. In addition their complex construction would put the cost out of reach of most individual families.

Improvements to this type of fire escape ladder, should overcome the disadvantages mentioned above, as well as prevent a trespasser or intruder from climbing the ladder when the ladder is in the closed, storage position.

Another example of a situation where a ladder is needed occasionally, but where safety considerations are also important, is with respect to swimming pool ladders, particularly the type used with above-ground pools. In this situation, the ladder should be easily usable when adults wish to enter or leave the pool, or where young children are being supervised by adults or older children. Use of the ladder by unsupervised young children, poses a significant danger and should be prevented.

U.S. Pat. No. 3,311,195 (Singer) discloses a safety guard for a pool ladder, which, in essence, is a large, flat board which fits over the steps of the ladder to prevent use. The board may be lifted away by an adult, but not by a young child. The safety guard of Singer may not readily be used when all the adults have entered the water and young children remain outside the pool, because it is difficult to re-secure the cover board from within the pool.

SUMMARY OF THE INVENTION

One object of the present invention is to provide a ladder which can be permanently or semi-permanently placed for occasional use and which has steps that are normally closed but which can easily and selectively be opened for the user to safely ascend or descend the ladder.

It is a more particular object to provide a ladder of this type for use with, for example, an above-ground swimming pool, in which the ladder inherently assumes a closed configuration that prevents use of the ladder, and is resistant to opening by a small child, but which can, with minimal effort by an older person, be transformed into an open position by which older children and adults can ascend or descend the ladder.

It is a further object of the invention to provide a ladder of this type, which is suitable for permanent attachment in a substantially vertical orientation to the exterior of a single family or similar residential building, and which in the closed position precludes use by trespassers or intruders, yet which can easily be opened from a window in the building for rapid and safe egress in the event of a fire or other need to escape.

In accordance with a broad aspect of the invention, the ladder includes a pair of spaced apart rails having upper and lower ends, and a plurality of substantially identical slats located between the rails. Each slat has a support axle or the like engaging the rails, and defining an axis of rotation for the slat. An actuating bar or rod is operatively connected to each of the slats for selectively and simultaneously rotating the slats from a closed position wherein the slats are substantially coplanar and parallel to the rails, to an open position wherein the slats are oriented transversely to the rails and thus form steps. The actuating bar or the like is restrained in the normally closed position. A trigger mechanism is located at the upper end of the rails and operatively connected to the actuating bar, for selectively releasing the restraining member, whereby the slats can rotate to the open position for use.

In the pool ladder embodiment of the invention, a spring member or the like biases the slats into the closed position. Actuation of the trigger mechanism must be coupled with the application of force on the slats, as by stepping, to maintain the slats in the open position. This arrangement automatically closes the slats once the user has ascended or descended the ladder, and prevents small children from climbing the ladder even if all the adults have entered the pool. Whether entering or leaving the pool, the adult actuates the trigger mechanism at the top of the rail with one hand, while stepping on the closed slat to transform the slats into steps, thus enabling ascent or descent of the ladder.

In the fire escape embodiment of the invention, the rails are vertically and rigidly mounted to the exterior surface of the building, such that the upper end of the ladder is adjacent a window sill. The slats are normally in the closed configuration to prevent climbing by an intruder or child. When the need for escape arises, the user need only open the window and actuate the trigger mechanism, so that the slats rotate into the open position. The user then descends the ladder in conventional fashion. With the fire escape ladder embodiment, no biasing of the slats into the closed position is needed, because once the ladder is opened, typically in an emergency situation, it should be as easy as possible for everyone else to follow the first person out the window and down the ladder, without repeatedly reopening the steps.

BRIEF DESCRIPTION OF THE DRAWINGS

These and other features and advantages of the invention will be described below with reference to the accompanying drawings, in which.

DESCRIPTION OF THE PREFERRED EMBODIMENT

Figure 1:
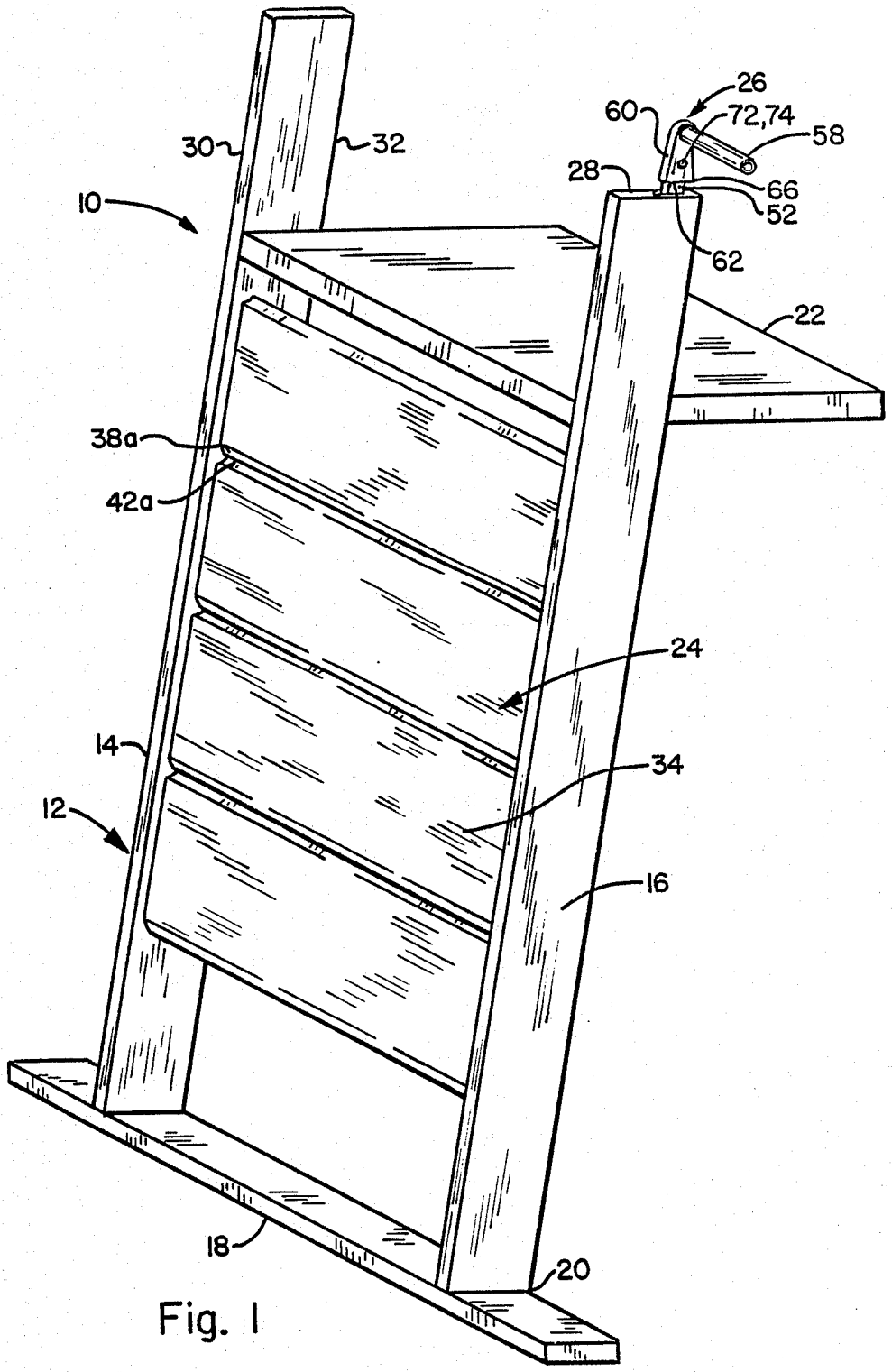
FIG. 1 is a perspective view of a pool ladder embodiment of the invention with the steps in the closed position.
Figure 2:
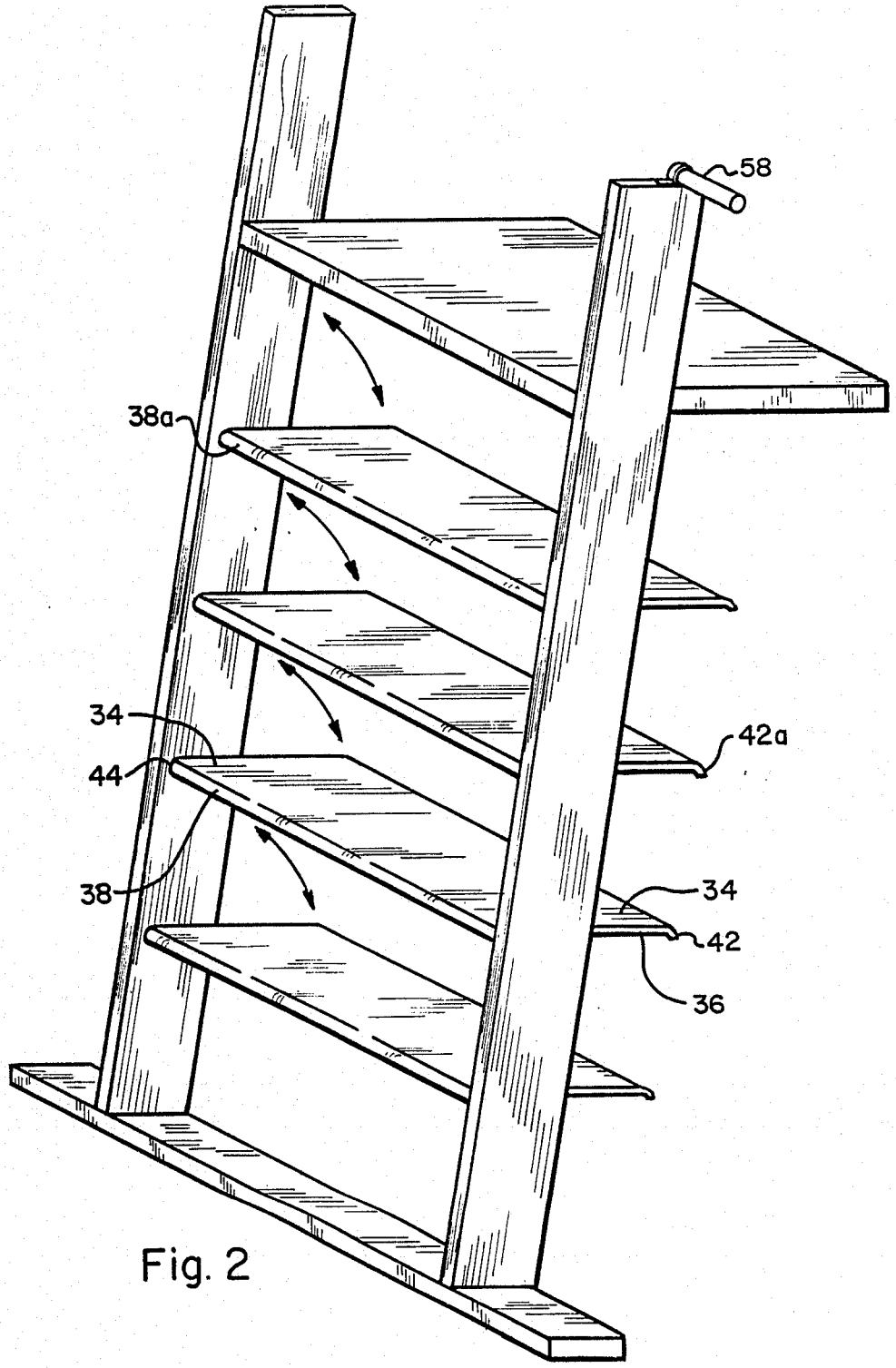
FIG. 2 is a perspective view similar to FIG. 1, showing the steps in the open position.

FIGS. 1 through 8 illustrate a first embodiment of the invention, adapted for use as an automatic pool safety ladder 10. The ladder includes a frame 12 having a pair of rails 14, 16, extending obliquely upward, substantially vertically, to which a base 18 is affixed at the lower end 20 and to which a platform 22 is affixed at any convenient elevation. Between the base 18 and platform 22, there are provided a plurality of steps 24 which, in a manner to be described below, are rotatable between a closed position as shown in FIG. 1, and an open position as shown in FIG. 2. The steps are normally in the closed position as shown in FIG. 1, and, by means of the trigger mechanism 26 at the upper end 28 of rail 16, the transition from the closed position of the steps to the open position is initiated.

For consistent directional reference hereinbelow, it should be understood that, the front of the ladder 30 faces away from the pool (not shown), whereas the back 32 of the ladder would face, or, in conjunction with the platform 22, be in contact with the pool. Thus, although the term "substantially vertical" has been used to describe the orientation of the rails 14, 16, it should be appreciated that, in use, the base 18 would rest horizontally on the ground, whereas the rails 14, 16 would typically be angled obliquely toward the upper end of the pool.

The steps 24 are formed by a plurality of substantially identical slats having a front surface 34, as shown in FIG. 1, which, in the open position, become the top surfaces 31 as shown in FIG. 2. Similarly each slat has a back or bottom surface 36, and a front edge 38 and a back edge 42. The dimension of each slat from front to back is such that, when the slats are oriented parallel to the rails, in the closed position, they form a substantially solid planar surface which cannot be ascended. Preferably, a given slat back edge 42*a* is curved slightly downwardly, such that as the slat 24 rotates upwardly, edge 42*a* forms a line contact against a portion of the front edge 38*a* of an adjacent slat.

Each slat includes a support member 46, either separate or integrally formed therewith, which penetrates the rails, as at 44. Preferably, the support member is in the form of an axle, which defines an axis of rotation for the slat. Each slat is, through the axle 46, connected to an actuating structure which, in the illustrated embodiment, includes a rotatable lever arm 48 rigidly connected to each axle, and a rigid actuating rod 50 extending parallel to the rails and pivotally connected to each of the lever arms 48 in offset relation to the axle 46. Thus, the actuating structure operatively connects together each of the slats for selective simultaneous downward rotation of the slats from a closed orientation wherein the slats are substantially coplanar and parallel to the rails, to an open orientation wherein the slats are transverse to the rails, and vica versa.

Figure 3:
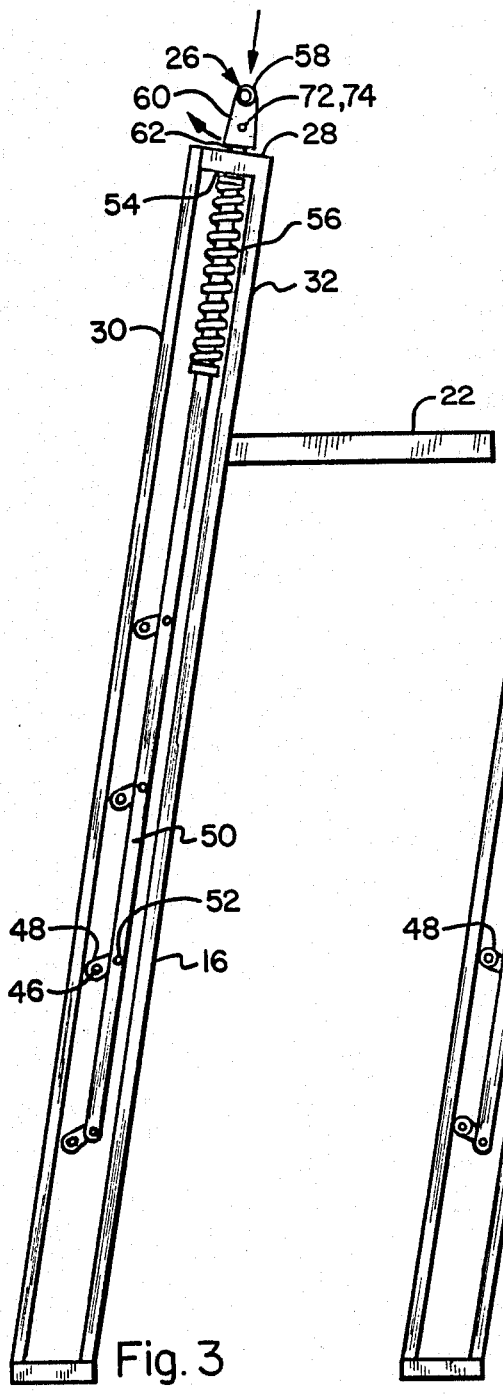
FIG. 3 is a side elevation view of FIG. 1, showing the steps in the closed position.

For use with a pool, it is desired that the default, or normal orientation of the slats be closed. Thus the actuating structure must be held or restrained in the closed position. As shown in FIG. 3, the closed position of the slats corresponds to the lever arms 48 having an obliquely upward orientation such that, if no restraining forces were imposed, the weight of the slats and rod 50, would tend to pivot the arms 48 downwardly to the position shown in FIG. 4, thereby opening the ladder. In the illustrated embodiment, a coil spring 56 is connected at one end to the rod 50 and at the other end to a portion 54 of the rail, such that a constant tension biases the rod 50 upwardly and thus maintains the slats in the closed orientation. With the trigger mechanism 26 of the illustrated embodiment, a lower surface 62 of the pedestal portion 60 of the trigger mechanism 26 has a default position in vertical engagement with the upper end 28 of the rail 16 and, thus, even without the action of the spring, the rod 50 cannot be lowered to open the slats.

Figure 4:
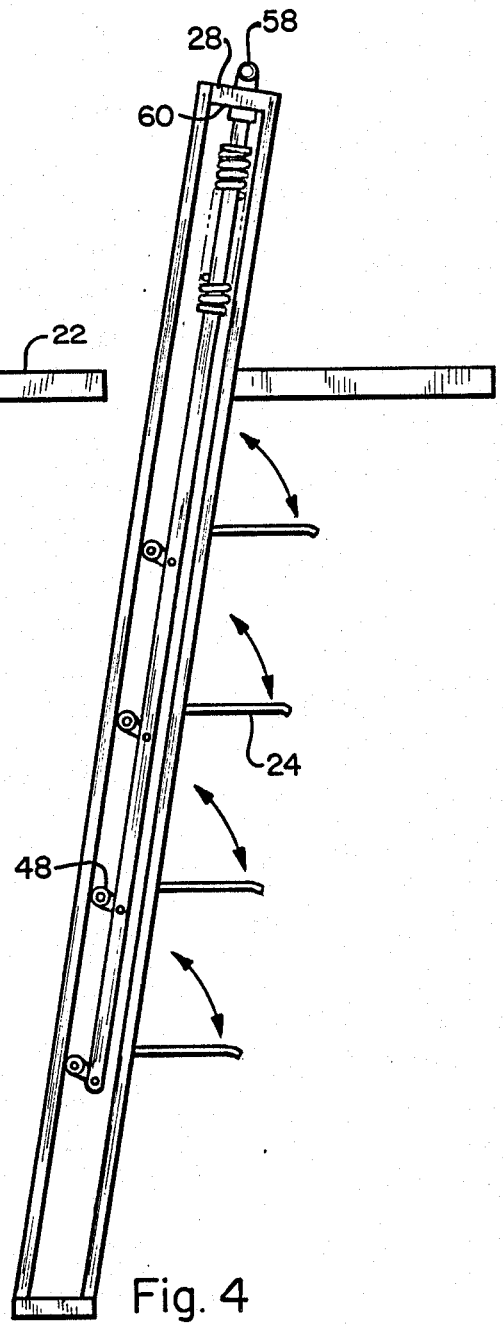
FIG. 4 is a side elevation view of FIG. 2, showing the steps in the open position.
Figure 5:
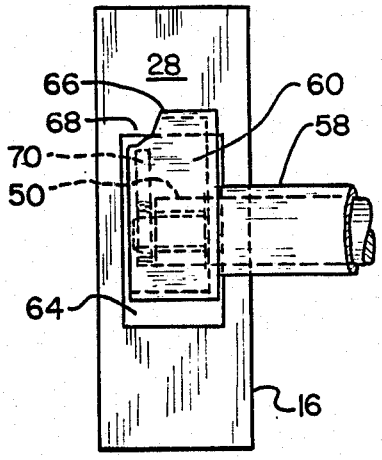
FIG. 5 is a top view of the rail and associated trigger mechanism of FIG. 1.
Figure 7:
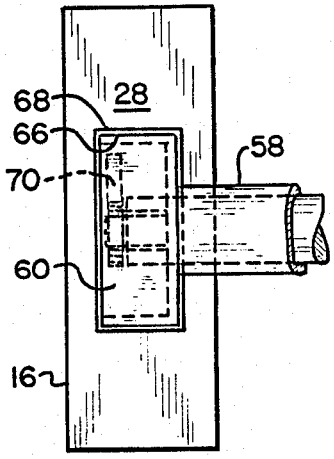
FIG. 7 is a top view of the rail and associated trigger mechanism shown in FIG. 2.

Only upon a positive rotation and downward force applied to handle 58, which removes the lower surface 62 of the pedestal 60 from vertical engagement with the upper end 28 of the rail 16, can the pedestal 60 drop in elevation relative to the rail upper end 28 and thus permit downward rotation of the arms 48 and opening of the steps 24, as shown in FIGS. 3 and 4. In practice, an adult standing on the ground would reach up and grab handle 58, rotate and pull it downward, then step on the lowermost slat 24 to overcome the tension bias of spring 56 and keep the slats 24 in the open position until the user has placed both feet on the platform 22. With no more weight on the slats 24 counteracting the bias of spring 56, the rod 50 is raised by the spring 56 and the slats 24 close automatically. Similarly, when the user is standing on the platform 22 after leaving the pool, he or she can rotate and push on handle 58, and with the heel place weight on a slat 24, to open the ladder.

FIGS. 5–8 show in greater detail, the manner in which the preferred trigger mechanism operates in connection with the pool ladder shown in FIGS. 1–4. The rod 50 penetrates the upper end 28 of the rail 16 through a rectangular passage or opening 64. The depth (front to rear) and width (side to side) dimensions of the passage 64 are slightly larger than the depth and width dimensions of the lower surface 62 of pedestal 60. The rear portion of the lower surface 62 of pedestal 60 forms a locking lip 66 which, in the default condition of the pivoting handle 58, overhangs the rearward width portion of the passage 64, which in effect defines a locking ledge 68. A spring arrangement 70 of any convenient configuration is mounted between the rod 50 and the pedestal 60, to urge the locking lip 66 rearwardly into an overhang relation relative to the locking ledge 68. Thus, in the default or neutral position, the rod 50 is biased upwardly, as by spring 56 (FIG. 3), and the locking lip 66 of the pedestal is urged rearwardly to overhang the locking ledge 68. In this condition, the steps 24 cannot open because the rod 50 is restrained from moving downwardly by the interference between the locking lip 66 and the locking ledge 68.

Figure 6:
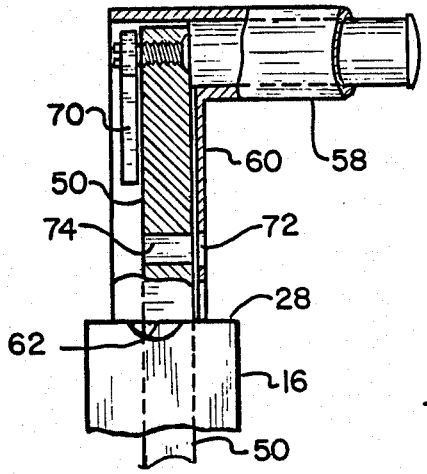
FIG. 6 is a front elevation view of the upper portion of the rail with the trigger mechanism in the position shown in FIG. 5.
Figure 8:
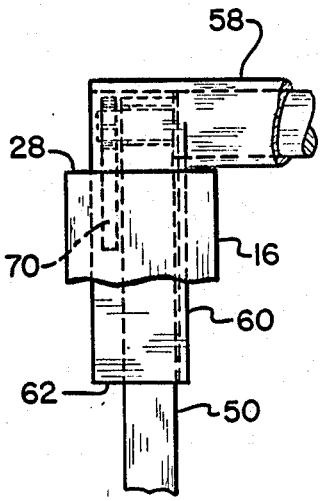
FIG. 8 is a front elevation view of the upper portion of the rail with the trigger mechanism in the position shown in FIG. 7.

In order to open the ladder, the user grasps the handle 58, which is rigidly connected to the pedestal 60, but is pivotally connected to the rod 50, and turns the handle toward the observer in FIG. 6, until the bias of spring 70 is overcome. Despite the weight of the stairs and the rod, there is relatively little resistance to this turning because the spring 56 (FIG. 3) is biasing the rod 50 upwardly. The pedestal 60 shrouds the upper end of the rod 50 and thus the depth dimension of the lower end 62 of pedestal 60, although less than that of the passage 64, is greater than that of the actuating rod 50, providing clearance between the pedestal 60 and the front and back surfaces of the rod 50. This clearance accommodates the rotation of the pivot handle 58 and the resulting frontward movement of the lower surface 62 and locking lip 66 of the pedestal. This frontward movement clears locking lip 66 from locking ledge 68 and, since the depth and width dimension of the pedestal 60 is less than the corresponding dimensions of passage 64, the rod and pedestal 60 are free to move downwardly through passage 64. This downward movement, as seen from above in FIGS. 5 and 7, and from the front in FIGS. 6 and 8, results in the opening of the steps 24.

As a further precaution to prevent unauthorized use of the ladder, a locking hole 72 is provided on the pedestal 60 and a second locking hole 74 is provided on the rod 50, the holes 72, 74 being coaxially aligned when the locking lip 66 overhangs the locking ledge 68, as shown in FIG. 6. With the holes 72, 74 thus aligned, a padlock may be secured through both holes to prevent displacement of the pedestal 60 relative to the rod 50, and thus by preventing movement of the locking lip 66 relative to the locking ledge 68, assuring that the ladder cannot be opened.

It should be appreciated that the bias provided by spring 56 can be implemented in a variety of ways, including spring loading of the axles 46 into the upward, closed position of the slats 24. Similarly, other types of trigger mechanisms and associated actuation mechanisms can be coupled together to perform the equivalent functions to those described in connection with the illustrated embodiment.

Figure 10:
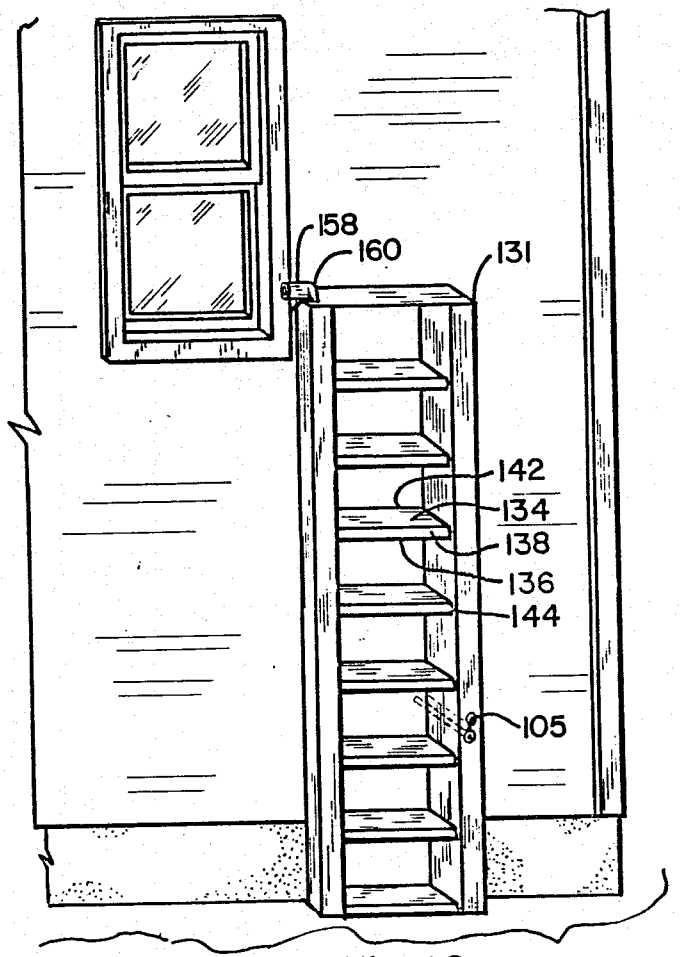
FIG. 10 is a view similar to FIG. 9, with the fire escape ladder in the open position.
Figure 9:
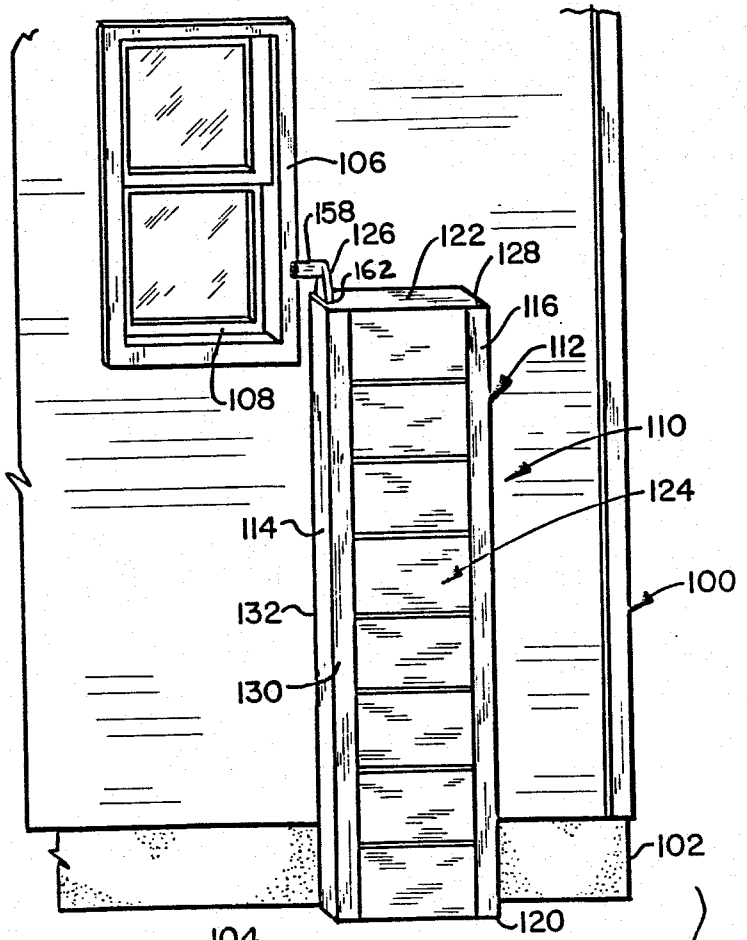
FIG. 9 is an elevation view of a portion of a building with a second embodiment of the invention attached thereto as a fire escape ladder in the closed position.

FIGS. 9 and 10 illustrate another embodiment of the invention, adapted for use as a fire escape ladder. In FIGS. 9 and 10, the structures identified by the last two digits of the numerals beginning with 100, correspond to analogous structures shown in FIGS. 1–8, identified with numerals having the same two digits.

In FIGS. 9 and 10, a building 100, such as a one or two story residence, rests on a foundation 102 which, typically, extends above ground level 104. The building includes a plurality of windows 106 at a second or third floor level, from which it would be dangerous for the occupants to jump to the ground in the event of a fire or similar need for rapid escape other than through the normal stairways and doors. In the event of a fire, and the need for urgent escape through such window 106, the occupants would open the sash and climb over the sill 108 to the ladder 110.

In accordance with the invention the ladder includes a frame 112 having a pair of spaced apart, vertical rails 114, 116, which are rigidly secured to the building 100. A representative bolt 105 or the like for this purpose, is shown in phantom in FIG. 10. The lower end 120 of the ladder is approximately at ground level 104, whereas the upper end 128 preferably includes a small platform 122 at an elevation slightly above that of the window sill 108. The platform helps provide rigidity to the frame 112, and serves as a cover to prevent debris and other accumulations between the frame 112 and the building 100. A plurality of steps 124 are connected between the rails 114, 116, and a trigger mechanism 126 is provided at the upper end 128 of rail 114, adjacent the window 106, within easy reach of anyone leaning out the window.

Each rail 114, 116, has front 130 and back 132 edges, which define a depth dimension. In a retrofit situation, the outer dimensions, or "envelope" are the same whether the ladder is in the closed or open position, with the distance of projection from the building being equal to the depth dimension of the rails. In new construction, the building could be made with a rectangular recess in the exterior wall, such that the rails fit into the recess and the front edges 130 are nearly flush with the wall exterior. Preferably, the rails are formed with the front edge 130 extruded with some flare, as shown at 131, to provide a channel for grasping with the fingers as the ladder is descended.

As in the embodiment shown in FIGS. 1–4, each slat or step 124 has a front or top surface 134, a back or lower surface 136, a front edge 138, and a back edge 142. Particularly with the embodiment shown in FIGS. 9 and 10, the rail penetration of the slat support member (such as axle 46 shown in FIG. 3), is near the front edge 138 of the slat 124. Moreover, preferably, the front to back distance, or depth, of the slat is substantially equal to the depth of the rails, whereby the front edge 138 of the slat is approximately flush with the front surface 130 of the rails. This configuration minimizes the space requirements of the ladder and is particularly well suited for recessed mounting into the building wall, as described above.

The trigger mechanism 126 is preferably similar to that shown in FIG. 6, including a handle 158, and a pedestal 160 having a lower surface 162. The normal, closed orientation of the slats 124 is maintained in the manner described with respect to the embodiment shown in FIGS. 1–4, by the pedestal lower surface 162 vertically engaging the upper end 128 of the rail 114 closer to the window sill 108. In the escape ladder embodiment, however, it is preferred that the spring 56 or equivalent bias shown in FIG. 3, be omitted, so that upon rotation and a very slight displacement of the trigger mechanism 26, the weight of the slats 24 and rod 50 rotate the slats into the open position. The steps 124 remain open Whether or not any downward force is applied to them, by virtue of the described mechanical linkages.

It should be understood that any form of stop member can be utilized to prevent the steps 24, 124 from passing beyond the desired, substantially horizontal open position. In the illustrated embodiments, the handle 58, when lowered into the position shown in FIGS. 2, 4, and 7, acts as a stop surface to prevent further downward displacement of the bar 50, and thus limits the downward rotation of the slats 24, 124 which are coupled to the bar 50.

It should be appreciated that the fire escape ladder embodiment of the invention is well adapted to the needs of a residential homeowner. It is rigidly secured to the building, occupies a relatively small envelope, and, if painted the same color as the building exterior, is relatively inconspicuous and unobtrusive. The trigger mechanism is actuable only from a second or higher story elevation, so that intruders or the like cannot open the ladder from below. When needed, the ladder can be easily opened by the first person escaping through the window, and others may readily follow. The steps have sufficient depth to permit the feet to have good, broad support while descending the ladder, and, in the preferred embodiment, the rails include channels or other protrusions which can easily be grasped to promote safe escape. These features and advantages are implemented in accordance with the invention, by a relatively inexpensive design which has few moving parts and which can be fabricated from conventional materials and components.

Although only two embodiments of the invention have been described in detail, it should be appreciated that other implementations of the invention may fall within the scope of the appended claims, and that such scope should not unnecessarily be restricted by the described embodiments.

I claim:

1. A ladder comprising:

a pair of spaced apart rails having front and back edges and having upper and lower ends;

a plurality of substantial identical slats located transversely between the rails;

support means extending from each slat and engaging the rails, for defining a respective axis of rotation for each slat;

actuating means operatively connecting together each of the slats for selective simultaneous rotation of the slats from a closed orientation wherein the slats form a substantially solid planar surface parallel to the rails, to an open orientation wherein the slats are spaced apart and transverse to the rails;

means for restraining the actuating means to hold the slats in the closed position; and trigger means located at the upper end of a rail and operatively connected to the actuation means., for selectively releasing the means for restraining, whereby the slats can rotate to the open orientation.

2. The ladder of claim 1, wherein the rails have a depth dimension from front to back and the slats have a depth dimension from front to back, said rail and slat depth dimensions being substantially equal.

3. The ladder of claim 1, further including means for rigidly connecting the rails vertically to the vertical exterior of a building.

4. The ladder of claim 2, wherein the support means extend from the front of each slat and engage respective rails near the rail front edge.

5. The ladder of claim 4, wherein the depth dimension of each slat is substantially equal to the distance between successive support means.

6. The ladder of claim 3, wherein each rail has a front edge that is flared to define a hand-hold channel.

7. The ladder of claim 3, wherein said support means includes an axle penetrating each rail.

8. The ladder of claim 3, wherein the means for restraining include a pedestal extending above the upper end of the rail and having lip selectively moveable by said trigger means from a first position vertically supported by said upper end to a second position intermediate the upper and lower ends of the rail.

9. The ladder of claim 3, in combination with a wall having a rectangular recess therein, said recess having a depth into said wall substantially equal to the depth dimension of said rails, and wherein said means for rigidly connecting the rails secures the rails within said recess.

10. The ladder of claim 7, wherein said actuation means includes a rigid rod oriented parallel to at least one rail, and rigidly connected in offset relation to each axle.

11. The ladder of claim 3, wherein said trigger means is connected to the means for restraining and to the actuation means, for manually selectively releasing the means for restraining, whereby the weight of the slats will cause all slats to rotate into the open position.

12. The ladder of claim 11, wherein said trigger means further includes a handle which is adapted to interact with the upper end of the rail to provide a stop surface limiting the downward rotation of the slats into the open position.

13. The ladder of claim 1 wherein the slats have front and back edges and said support means extends from each slat near the slat front edge and engages a respective rail near the rail front edge.

14. The ladder of claim 13, wherein the depth dimension of each slat from front to back edges is at least equal to the distance between successive support means.

15. The ladder of claim 1, wherein the slats rotate downwardly from the closed to the open position.

16. The ladder of claim 1, wherein the actuation means pass longitudinally through at least one rail.

17. The ladder of claim 1, wherein said support means includes an axle penetrating each rail.

18. The ladder of claim 17, wherein said actuating means includes a rigid rod passing parallel to the rail and rigidly connected in offset relation to each axle.

19. The ladder of claim 1, wherein said means for restraining include spring means for biasing the support means in the closed position.

20. The ladder of claim 1, wherein said trigger means is connected to the means for restraining and to the actuation means, for manually selectively releasing the means for restraining, whereby the application of force on any slat will cause all slats to rotate into the open position.

* * * * *